US011970793B2

(12) United States Patent
Lin et al.

(10) Patent No.: US 11,970,793 B2
(45) Date of Patent: Apr. 30, 2024

(54) COMPOSITE YARN, FABRIC THEREOF AND BRASSIERE

(71) Applicant: MACKENT GROUP CO., LTD., Taoyuan (TW)

(72) Inventors: Yi-Chen Lin, Taoyuan (TW); Po-Jen Shih, Taoyuan (TW)

(73) Assignee: MACKENT GROUP CO., LTD., Taoyuan (TW)

( * ) Notice: Subject to any disclaimer, the term of this patent is extended or adjusted under 35 U.S.C. 154(b) by 0 days.

(21) Appl. No.: 17/412,814

(22) Filed: Aug. 26, 2021

(65) Prior Publication Data

US 2021/0381134 A1 Dec. 9, 2021

Related U.S. Application Data

(62) Division of application No. 16/132,889, filed on Sep. 17, 2018, now abandoned.
(Continued)

(30) Foreign Application Priority Data

May 4, 2018 (TW) ..... 107115350

(51) Int. Cl.
*A41C 3/00* (2006.01)
*A41C 3/14* (2006.01)
(Continued)

(52) U.S. Cl.
CPC ..... *D02G 3/045* (2013.01); *A41C 3/0014* (2013.01); *A41C 3/144* (2013.01); *D02G 3/32* (2013.01);
(Continued)

(58) Field of Classification Search
None
See application file for complete search history.

(56) References Cited

U.S. PATENT DOCUMENTS 4,601,940 A * 7/1986 Fischer ..... D04B 21/207 264/258
6,033,779 A 3/2000 Andrews
(Continued)

FOREIGN PATENT DOCUMENTS

CN 204491122 U 7/2015
CN 205624537 U 10/2016
(Continued)

OTHER PUBLICATIONS

Office Action issued in Taiwan patent application 107115350 dated Jan. 30, 2019, 10 pages.

*Primary Examiner* — Shaun R Hurley
*Assistant Examiner* — Grace Huang
(74) *Attorney, Agent, or Firm* — Muncy, Geissler, Olds & Lowe, P.C.

(57) ABSTRACT

A fabric of a cup body of a brassiere includes an inner textile layer, an outer textile layer and a middle textile layer. A first weaving region and a second weaving region of the outer textile layer respectively include a plurality of composite yarns. Each of the composite yarns includes a first yarn and a second yarn. A melting point of the first yarn is lower than a melting point of the second yarn, and an offset rate of the second yarn relative to the first yarn is from 5% to 300%. A content of the composite yarns in the first weaving region is greater than that in the second weaving region. A content of the composite yarns in a third weaving region of the outer textile layer is less than that in the second weaving region. The first weaving region is at a lifting area of the cup body.

3 Claims, 4 Drawing Sheets

Related U.S. Application Data

(60) Provisional application No. 62/581,994, filed on Nov. 6, 2017, provisional application No. 62/559,837, filed on Sep. 18, 2017.

(51) Int. Cl.

| | |
|---|---|
| ***D02G 3/04*** | (2006.01) |
| ***D02G 3/32*** | (2006.01) |
| ***D02G 3/38*** | (2006.01) |
| ***D03D 1/00*** | (2006.01) |
| ***D03D 7/00*** | (2006.01) |
| *A41C 5/00* | (2006.01) |

(52) U.S. Cl.

CPC ..... *D02G 3/38* (2013.01); *D03D 1/00* (2013.01); *D03D 7/00* (2013.01); *D10B 2321/022* (2013.01); *D10B 2331/04* (2013.01); *D10B 2331/10* (2013.01); *D10B 2401/061* (2013.01); *D10B 2403/021* (2013.01); *D10B 2403/0241* (2013.01); *D10B 2501/02* (2013.01)

(56) References Cited

U.S. PATENT DOCUMENTS

| | | | | |
|---|---|---|---|---|
| 6,230,524 | B1 * | 5/2001 | Kolmes | D02G 3/402 66/172 R |
| 6,685,535 | B2 * | 2/2004 | Mitchell | D04B 1/246 450/75 |
| 8,388,406 | B2 * | 3/2013 | Liu | A41C 3/12 450/39 |
| 9,538,794 | B2 * | 1/2017 | Turlan | D04B 1/102 |
| 9,565,877 | B2 * | 2/2017 | Martinet | A41C 3/065 |
| 10,179,960 | B2 * | 1/2019 | Diaz | A41C 3/0057 |
| 2002/0034637 | A1 * | 3/2002 | Yoshioka | D04H 1/43835 428/375 |
| 2003/0055206 | A1 | 3/2003 | Haile et al. | |
| 2007/0219323 | A1 | 9/2007 | Bruning | |
| 2017/0079333 | A1 * | 3/2017 | Hsiao | A41C 3/0014 |
| 2018/0002839 | A1 | 1/2018 | Liao et al. | |
| 2018/0310643 | A1 * | 11/2018 | Hanson Allen | A41C 3/12 |
| 2022/0192280 | A1 * | 6/2022 | Burton | D04B 1/102 |
| 2023/0210195 | A1 * | 7/2023 | Smyczek | A41C 3/0057 450/1 |
| 2023/0232912 | A1 * | 7/2023 | Roeleveld | A41C 3/0007 450/1 |
| 2023/0301370 | A1 * | 9/2023 | Gunasekara | A41C 3/0014 |

FOREIGN PATENT DOCUMENTS

| | | | | |
|---|---|---|---|---|
| CN | 108893833 | A * | 11/2018 | D02G 3/04 |
| GB | 2469691 | A * | 10/2010 | A41C 3/10 |
| TW | M426604 | U | 4/2012 | |
| TW | M518476 | U | 3/2016 | |

* cited by examiner

COMPOSITE YARN, FABRIC THEREOF AND BRASSIERE

CROSS-REFERENCES TO RELATED APPLICATIONS

This application is a Divisional of co-pending application Ser. No. 16/132,889, filed on Sep. 17, 2018, for which priority is claimed under 35 U.S.C. § 120; and this application claims the priority benefit of U.S. provisional application Ser. No. 62/559,837, filed on Sep. 18, 2017, Ser. No. 62/581,994, filed on Nov. 6, 2017, and Patent Application No. 107115350 filed in Taiwan, R.O.C. on May 4, 2018. The entirety of the above-mentioned patent applications are hereby incorporated by references herein and made a part of the specification.

BACKGROUND

Technical Field

The instant disclosure relates to textile fabrics, in particular, to a composite yarn, a fabric thereof, and a brassiere.

Related Art

Consumers have more and more requirements on textile functionalities. For example, for those underclothes like bras, stretchy suits, or stretchy pants, consumers are seeking for not only beautiful appearances but also, based on different purposes, proper functionalities. Therefore, the textiles can provide a better wearing experience for the users.

Taking the bra as an example, the cup is an important piece for a bra, and the functionality required for the cup is very high. The purpose for wearing a bra is to cover, focus, and lift up the user's breast by the structure and the material of the cup. The bra allows, by protecting, lifting, and shaping user's breast, the user to present the shape of a female wonderful body curve. Furthermore, the bra can also be provided to prevent the user's breast from sagging and to modify the shape of the breast. A bra known to the inventor has a lifting sheet at the inner side of the cup to lift the breast up. However, the lifting sheet is cut from a flat material without elasticity. As a result, the cup cannot be attached on the breast smoothly, and the user may feel uncomfortable easily.

A cup known to the inventor is manufactured by mixing thermo-fusible yarns and other yarns, and the cup has a better structural strength and a better supporting performance. However, textiles containing the thermo-fusible yarns normally have problems like uncomfortable wearing experience and rough texture. As a result, the cup manufactured by the textiles containing the thermo-fusible yarns is hard to be attached on the user's skin smoothly. Even if when the cup is attached to the user's skin smoothly, the user may still have severely uncomfortable wearing experience.

SUMMARY

In one embodiment, a composite yarn comprises a first yarn and a second yarn. The first yarn is a thermo-fusible yarn. The second yarn is winded and intermingled on the surface of the first yarn. Furthermore, the melting point of the first yarn is lower than the melting point of the second yarn. Taking a unit length of the composite yarn as a standard, the offset rate of the second yarn relative to the first yarn is between 5% and 300%.

In one embodiment, a fabric comprises an inner textile layer, an outer textile layer, and a middle textile layer between the inner textile layer and the outer textile layer. The inner textile layer comprises microfiber yarns and elastic fiber yarns. The outer textile layer comprises a plurality of aforementioned composite yarns, and the middle textile layer comprises a plurality of wave-like polyester fiber yarns. Furthermore, the outer textile layer has a first weaving region and a second weaving region, and the content of the composite yarns in the first weaving region is greater than the content of the composite yarns in the second weaving region.

In one embodiment, a brassiere comprises a cup body. The cup body comprises the aforementioned fabric. The cup body comprises a lifting area and an attaching area adjacent to the lifting area. The first weaving region of the fabric is at the lifting area, and the second weaving region of the fabric is at the attaching area.

Accordingly, the fabric according to one or some embodiments of the instant disclosure is suitable for manufacturing brassiere as well as stretchy suits/pants, sportswear, etc. By adjusting or managing the contents of the composite yarns in the weaving regions, the weaving regions can perform different functionalities (supporting performance, confining performance, lifting performance, and fitting performance), so that fabrics with different functionalities can be manufactured for specific portions of the user's body. Further, when the fabric according to one or some embodiments of the instant disclosure is applied for manufacturing sportswear, the use of the fabric in the sportswear facilitates the protection for the user's muscle and reduces the possibility of sports injury.

BRIEF DESCRIPTION OF THE DRAWINGS

The disclosure will become more fully understood from the detailed description given herein below for illustration only, and thus not limited to the disclosure, wherein.

DETAILED DESCRIPTION

In this specification, the term "content of yarn(s)" indicates that the content of a certain yarn in a fabric in which the total amount of yarns in the fabric is 100%.

In this specification, the term "offset rate" indicates that the length difference between two yarns taking a unit length of a composite yarn intermingled by two or more yarns. For example, taking a unit length of a composite yarn intermingled by a first yarn and a second yarn as a standard, when the length of the second yarn is 1.5 times of the length of the first yarn, the offset rate of the second yarn relative to the first yarn is 50%.

Figure 1:
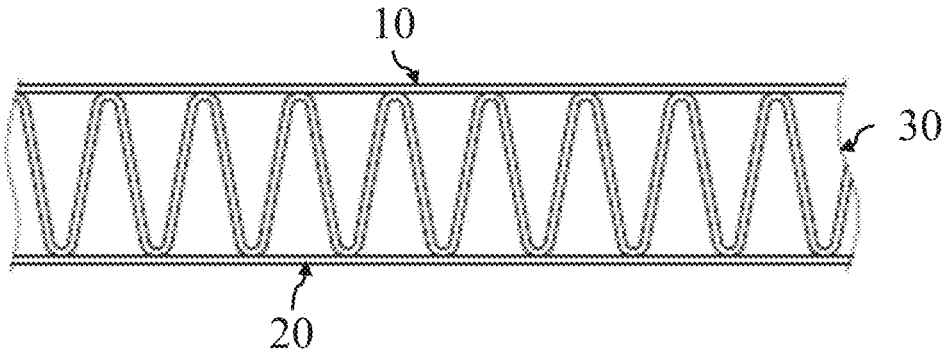
FIG. 1 illustrates a lateral view of a fabric according to one embodiment of the instant disclosure.

Please refer to FIG. 1. In some embodiments, a fabric may comprise an inner textile layer 10, an outer textile layer 20, and a middle textile layer 30. The middle textile layer 30 may be between the inner textile layer 10 and the outer textile layer 20.

In some embodiments, the inner textile layer 10 may comprise microfiber yarns and/or elastic fiber yarns. In some embodiments, the inner textile layer 10 may be substantially consisting of the microfiber yarns and/or the elastic fiber yarns. That is, the inner textile layer 10 may comprise the microfiber yarns and/or the elastic fiber yarns as well as other yarns or other materials. In some embodiments, the inner textile layer 10 may comprise at least one selected from a group consisting of the microfiber yarns and the elastic fiber yarns.

In some embodiments, the size of the microfiber yarns may be below 150 deniers or below 30 deniers.

In some embodiments, the size of the elastic fiber yarns may be below 150 deniers or below 30 deniers. Further, in some embodiments, the material of the elastic fiber yarn may be polyurethane (PU), other alternatives, or any combinations of the foregoing. In other words, the material of the elastic fiber may be at least one selected from a group consisting of polyurethane (PU), other alternatives, or any combinations of the foregoing.

Figure 2:
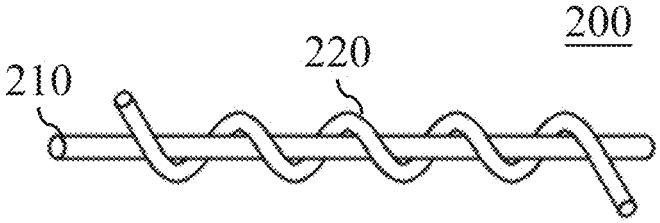
FIG. 2 illustrates a plan view of a composite yarn according to one embodiment of the instant disclosure.

In some embodiments, the outer textile layer 20 may comprise a composite yarn 200. Please refer to FIG. 2. In some embodiments, the composite yarn 200 may comprise a first yarn 210 and a second yarn 220. The first yarn 210 may be thermo-fusible yarn. The second yarn 220 is winded and intermingled on the surface of the first yarn 210. Further, in some embodiments, the outer textile layer 20 may further comprise a plurality of elastic fiber yarns. That is, the outer textile layer 20 may be the composite yarns 200 and the elastic fiber yarns. In some embodiments, the outer textile layers 20 may comprise the composite yarns 200 and the elastic fiber yarns as well as other yarns or other materials. In some other embodiments, the outer textile layer 20 may only have the composite yarns 200 and the elastic fiber yarns.

In some embodiments, the first yarn 210 (i.e., the thermo-fusible yarn) may have a core-spun yarn structure with a surface formed by a thermo-fusible fiber. Specifically, different kinds of fibers may be utilized as the core fiber and enclosed by the thermo-fusible fiber to form the thermo-fusible yarn with the core-spun yarn structure, and the melting point of the core fiber is higher than the melting point of the thermo-fusible fiber. In some embodiments, a polyester fiber may be enclosed by the thermo-fusible fiber to form the thermo-fusible yarn with the core-spun yarn structure. Further, in some embodiments, the material of the thermo-fusible fiber may be polypropylene, low temperature based polyethylene terephthalate (LPET), other alternatives, or any combinations of the foregoing. In other words, the material of the thermo-fusible fiber may be at least one selected from a group consisting of polypropylene, low temperature-based polyethylene terephthalate (LPET), other alternatives, or any combinations of the foregoing.

In some embodiments, the second yarn 220 may be uniformly winded on the surface of the first yarn 210. When the first yarn 210 is exposed under an environment having a temperature higher than the melting point of the thermo-fusible fiber of the first yarn 210 for thermal treatment, the thermo-fusible fiber on the surface of the first yarn 210 are softened or melted and firmly adhered with the second yarn 220 to form a single composite yarn 200. Here, as compared with a thermo-fusible yarn with the same thermal treatment, the composite yarn 200 still has the second yarn 220 on the surface of the composite yarn 200 after the thermal treatment. Therefore, the composite yarn 200 can provide a greater hand feeling as compared with the thermo-fusible yarn. Moreover, the fabric manufactured by the composite yarn 200 can provide a texture and a hand feeling similar to or same as a fabric without thermo-fusible fiber.

In some embodiments, taking a unit length of the composite yarn 200 as a standard, the offset rate of the second yarn 220 relative to the first yarn 210 is between 5% and 300%, for example, may be between 20% and 40%, or for example, may be 30%.

In some embodiments, the melting point of the first yarn 210 is lower than the melting point of the second yarn 220. For example, the melting point of the first yarn 210 may be between 160 Celsius and 190 Celsius, and the melting point of the second yarn 220 may be between 200 Celsius and 260 Celsius.

In some embodiments, the second yarn 220 may be normal polyethylene terephthalate (PET), other alternatives, or any combinations of the foregoing. In other words, the second yarn 220 may be at least one selected from a group consisting of normal polyethylene terephthalate (PET), other alternatives, or any combinations of the foregoing.

Figure 3:
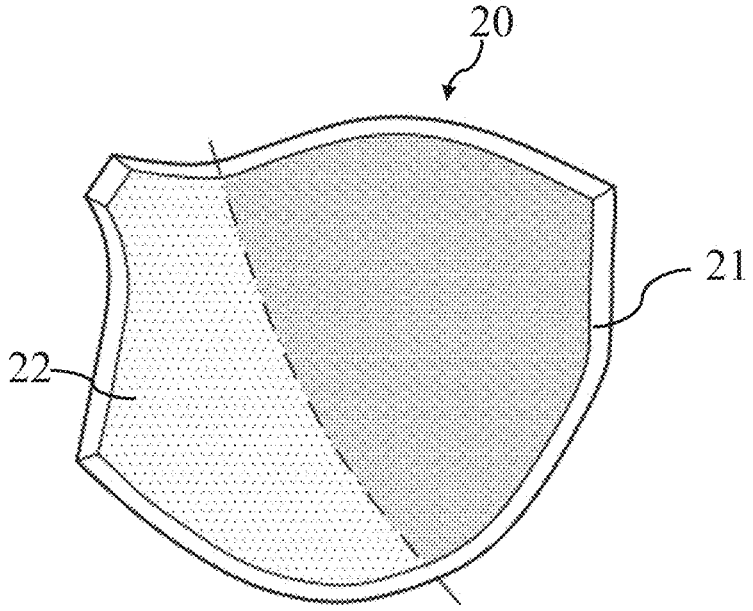
FIG. 3 illustrates a schematic view of an implementation of a lifting area and an attaching area of a cup body according to one embodiment of the instant disclosure.

Please refer to FIG. 3. In some embodiments, the outer textile layer 20 may have a first weaving region 21 and a second weaving region 22. By adjusting the contents of the composite yarns 200 in the first weaving region 21 and/or the contents of the composite yarns 200 in the second weaving region 22, the first weaving region 21 and the second weaving region 22 can provide different structural properties. For example, when the content of the composite yarn 200 in a weaving region of the fabric is higher, this weaving region can provide a stronger structural strength. Therefore, the weaving region can provide proper confining and supporting performances corresponding to a specific part of the user's body.

In some embodiments, when the content of the composite yarns 200 is 80%, it is indicated that 80% of the outer textile layer 20 is of the composite yarns 200. In some embodiments, the content of the composite yarns 200 in the first weaving region 21 may be greater than the content of the composite yarns 200 in the second weaving region 22. For example, the content of the composite yarns 200 in the first weaving region 21 may be between 70% and 80%, and the content of the composite yarns 200 in the second weaving region 22 may be between 20% and 60%.

Figure 4:
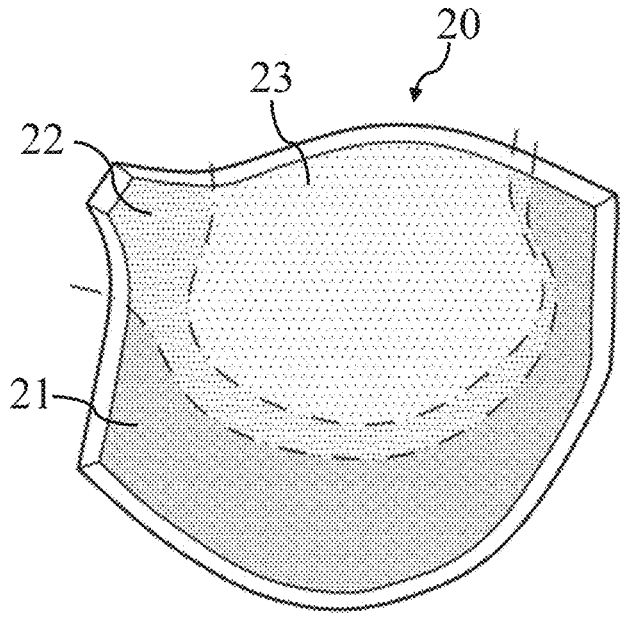
FIG. 4 illustrates a schematic view of an implementation of a lifting area and an attaching area of a cup body according to another embodiment of the instant disclosure.

Please refer to FIG. 4. In some embodiments, the outer textile layer 20 may further comprise a third weaving region 23. Furthermore, the content of the composite yarns 200 in the third weaving region 23 is different from the content of the composite yarns 200 in the first weaving region 21, and the content of the composite yarns 200 in the third weaving region 23 is also different from the content of the composite yarns 200 in the second weaving region 22. For example, the content of the composite yarns 200 in the second weaving region 22 is less than the content of the composite yarns 200 in the first weaving region 21, and the content of the composite yarns 200 in the third weaving region 23 is less than the content of the composite yarns 200 in the second weaving region 22. For example, the content of the composite yarns 200 in the first weaving region 21 may be between 60% and 80%, the content of the composite yarns 200 in the second weaving region 22 may be between 20% and 40%, and the content of the composite yarns 200 in the third weaving region 23 may be from near 0% and 20%. In some embodiments, because the third weaving region 23 may mainly include elastic fiber yarns and a small number of composite yarns 200, the content of the composite yarns 200 in the third weaving region 23 may be near 0%.

Here, according to production requirements, the fabric according to one or some embodiments of the instant disclosure may be utilized for manufacturing clothes or uppers of shoes, for example, underwear, stretchy suits/pants, sportswear, socks, or uppers of sports shoes. Moreover, the positions of the first weaving region 21, the second weaving region 22, and/or the third weaving region 23 may be arranged to correspond to different portions of a user's body for evaluating the suitable contents of the composite yarns 200 in each weaving region. Hence, the manufactured cloth can provide proper supporting performance, confining performance, fitting performance, so that when the user wears the cloth, the cloth not only provides a better body feeling but also protects user's muscle and reduces the possibility of sports injury.

Figure 5:
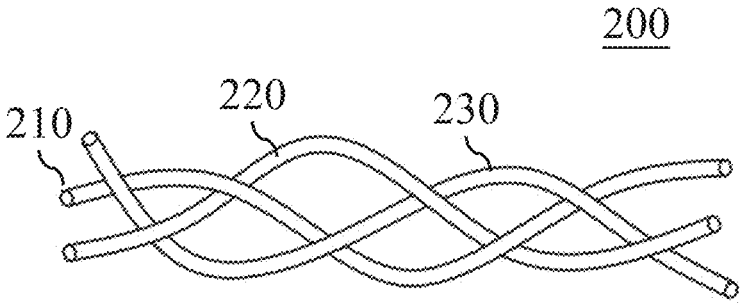
FIG. 5 illustrates a plan view of a composite yarn according to another embodiment of the instant disclosure.

Moreover, please refer to FIG. 5. In some embodiments, the composite yarn 200 may further comprise a third yarn 230. The third yarn 230 is an elastic yarn, and the first yarn 210, the second yarn 220, and the third yarn 230 are intermingled and cohered with each other. Under an environment having a temperature higher than the melting point of the thermo-fusible fiber on the surface of the first yarn 210, the first yarn 210 is softened or melted to provide adhesive property for adhering with the second yarn 220 and the third yarn 230. Moreover, the composite yarn 200 manufactured by the intermingled process has several intermingled nodes. The formation of the intermingled nodes allows the first yarn 210, the second yarn 220, and the third yarn 230 to be combined with each other closely. Therefore, the composite yarn 200 can provide a higher structural strength.

Similarly, as compared with a thermo-fusible yarn with the same thermal treatment, the composite yarn 200 still has the second yarn 220 and the third yarn 230 on the surface of the composite yarn 200 after the thermal treatment. Therefore, the composite yarn 200 can provide a greater hand feeling as compared with the thermo-fusible yarn. Moreover, the fabric manufactured by the composite yarn 200 having the second yarn 220 and the third yarn 230 can provide a texture and a hand feeling similar to or same as a fabric without thermo-fusible fiber.

In some embodiments, the third yarn 230 may be an elastic fiber yarn or other alternative yarns.

In some embodiments, the middle textile layer 30 may comprise polyester fiber yarns. In some embodiments, the middle textile layer 30 may be substantially consisting of polyester fiber yarns. That is, the middle textile layer 30 may comprise polyester fiber yarns and other negligible yarns or materials. In some embodiments, the middle textile layer 30 may only have polyester fiber yarns.

Furthermore, in some embodiments, the polyester fiber yarns of the middle textile layer 30 may be wave-shaped. Hence, the polyester fiber yarn may have a peak and a valley. The peak of each of the polyester fiber yarns is connected to the outer textile layer 20, and the valley of each of the polyester fiber yarns is connected to the inner textile layer 10.

In some embodiments, the wave-like polyester fiber yarn of the middle textile layer 30 may be a monofilament fiber or a multifilament fiber.

Figure 6:
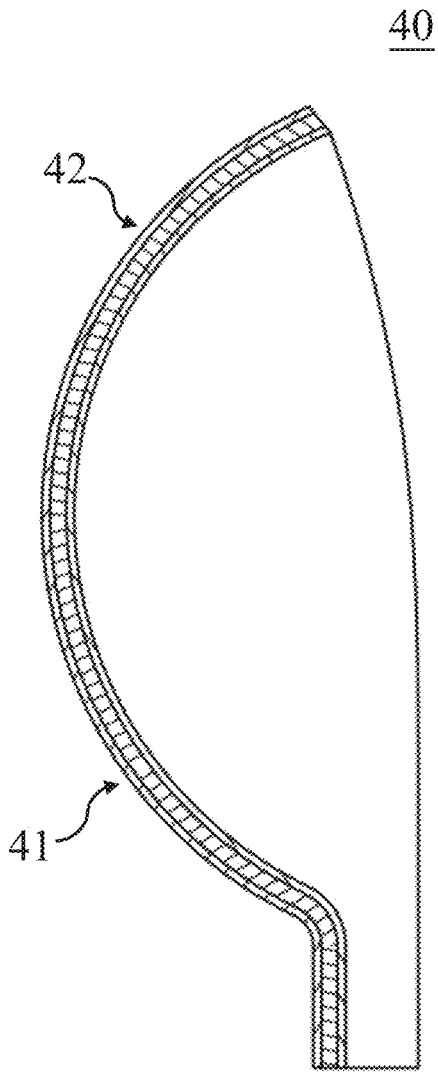
FIG. 6 illustrates a lateral view of a cup body according to one embodiment of the instant disclosure.

For example, the fabric according to one or some embodiments of the instant disclosure may be utilized for manufacturing a brassiere. Please refer to FIG. 6. A brassiere comprises a cup body 40 having a lifting area 41 and an attaching area 42. The attaching area 42 is adjacent to the lifting area 41 and above the lifting area 41, as shown in FIG. 6. Please refer to FIG. 4 again. The first weaving region 21 and the second weaving region 22 of the fabric are at the lifting area 41, and the third weaving region 23 of the fabric is at the attaching area 42. For example, the content of the composite yarns 200 in the first weaving region 21 is about 80%, the content of the composite yarns 200 in the second weaving region 22 is about 60%, and the content of the composite yarns 200 in the third weaving region 23 is about 20%. Moreover, the first weaving region 21, the second weaving region 22, and the third weaving region 23 are arranged in order, according to the contents of the composite yarns 200 in the first weaving region 21, the contents of the composite yarns 200 in the second weaving region 22, and the contents of the composite yarns 200 in the third weaving region 23, respectively. Here, the contents of the composite yarns 200 is gradually decreased from the bottom to the top of the outer textile layer 20 and the structural strength of the outer textile layer 20 is also reduced from the bottom to the top. Therefore, when a user wears the brassiere, the lifting area 41 at the lower portion of the cup body 40 can allow the muscle at the outer sides of the user's breast to be focused inwardly and to lift up the breast, and the attaching area 42 can enclose and fit the user's breast smoothly to provide proper wearing experience.

Accordingly, the fabric according to one or some embodiments of the instant disclosure is suitable for manufacturing brassiere as well as stretchy suits/pants, sportswear, etc. By adjusting or managing the contents of the composite yarns in the weaving regions, the weaving regions can perform different functionalities (supporting performance, confining performance, lifting performance, and fitting performance), so that fabrics with different functionalities can be manufactured for specific portions of the user's body. Further, when the fabric according to one or some embodiments of the instant disclosure is applied for manufacturing sportswear, the use of the fabric in the sportswear facilitates the protection for the user's muscle and reduces the possibility of sports injury.

What is claimed is:

1. A brassiere, comprising:

a cup body comprising a fabric, and the cup body comprising:

a lifting area; and an attaching area adjacent to the lifting area;

wherein the fabric comprises:

an inner textile layer comprising a plurality of microfiber yarns and a plurality of elastic fiber yarns;

an outer textile layer comprising a first weaving region, a second weaving region and a third weaving region, the first weaving region and the second weaving region respectively comprising a plurality of composite yarns, each of the composite yarns comprising:

a first yarn, wherein the first yarn is a thermo-fusible yarn;

a second yarn winded and intermingled with the first yarn; and wherein, a melting point of the first yarn is lower than a melting point of the second yarn, and an offset rate of the second yarn relative to the first yarn is from 5% to 300%, wherein a content of the composite yarns in the first weaving region is greater than a content of the composite yarns in the second weaving region;

wherein, the third weaving region comprises a plurality of elastic fiber yarns and the composite yarns, and a content of the composite yarns in the third weaving region is less than the content of the composite yarns in the second weaving region; and a middle textile layer between the inner textile layer and the outer textile layer, wherein the middle textile layer comprises a plurality of wave-like polyester fiber yarns;

wherein, the first weaving region of the fabric is at the lifting area and the second weaving region of the fabric is at the attaching area.

2. The brassiere according to claim 1, wherein the first weaving region of the fabric is at the lifting area, and the second weaving region and the third weaving region of the fabric are at the attaching area.

3. The brassiere according to claim 1, wherein the first weaving region and the second weaving region of the fabric are at the lifting area, and the third weaving region of the fabric is at the attaching area.

* * * * *